United States Patent [19]

Feld

[11] Patent Number: 4,643,210

[45] Date of Patent: Feb. 17, 1987

[54] INFLATABLE UMBRELLA

[76] Inventor: Oscar Feld, 2965 Avenue Z, Brooklyn, N.Y. 11235

[21] Appl. No.: 764,634

[22] Filed: Aug. 12, 1985

[51] Int. Cl.[4] ..... A45B 19/02

[52] U.S. Cl. ..... 135/20 B; 135/22; 135/24

[58] Field of Search ..... 135/20 B, 22, 24

[56] References Cited

U.S. PATENT DOCUMENTS

| | | | |
|---|---|---|---|
| 2,736,329 | 2/1956 | Cornellier | 135/20 B |
| 2,753,878 | 7/1956 | Halberstam | 135/20 B |
| 2,810,391 | 10/1957 | Jones, Jr. | 135/20 B |
| 3,954,117 | 5/1976 | Wallace | 135/20 B |
| 4,523,601 | 6/1985 | Grady | 135/20 B |

FOREIGN PATENT DOCUMENTS

| | | | |
|---|---|---|---|
| 1200717 | 7/1959 | France | 135/20 B |
| 444394 | 2/1968 | Switzerland | 135/20 B |
| 1250616 | 10/1971 | United Kingdom | 135/20 B |
| 1547742 | 6/1979 | United Kingdom | 135/20 B |

*Primary Examiner*—Albert W. Davis, Jr.
*Attorney, Agent, or Firm*—Howard M. Schwinger

[57] ABSTRACT

An inflatable umbrella consisting of canopy and handle which may be folded and conveniently carried about on the person and which has in its handle a compartment for a cartridge which can emit a pressurized gas for inflating the umbrella and has air passages formed in the canopy extending both circularly and radially with respect to the canopy, the air passages intersecting at a plurality of points.

1 Claim, 3 Drawing Figures

INFLATABLE UMBRELLA

This invention relates to umbrellas and more particularly to inflatable umbrellas.

The concept of an inflatable umbrella has long intrigued umbrella designers. The attraction of an inflatable umbrella is that it can be folded into handkerchief size and conveniently carried about in a garment pocket. This feature is most desirable and one that has been long pursued.

The problem facing the designers is the manner of inflating the umbrella. Proposals have ranged from hand pumps to inflation by breath.

It is thus an important object of the present invention to provide an efficient manner of inflating an inflatable umbrella.

It is another important object of the present invention to provide a manner of inflating an inflatable umbrella which will not detract from its portability.

It is a further object of the present invention to provide an inflatable umbrella with a system of air passages which will most efficiently handle the air introduced into the system and lead to rapid inflation.

Figure 1:
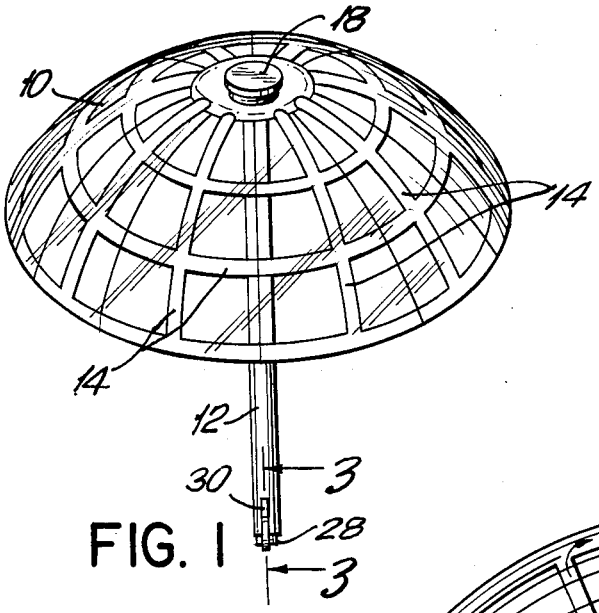
Figure 2:
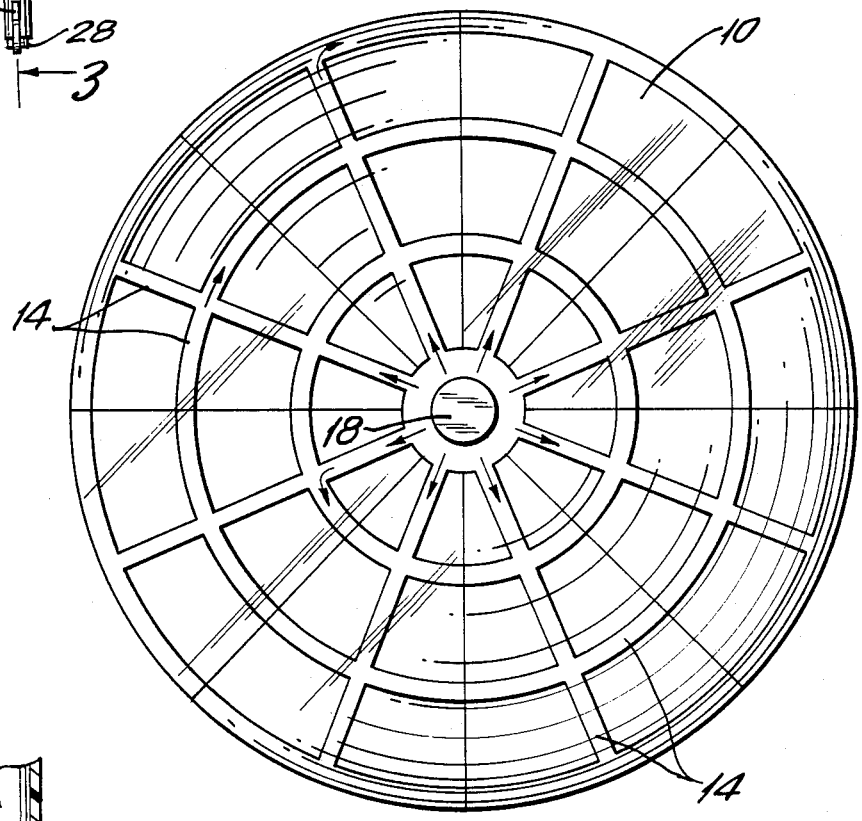
Figure 3:
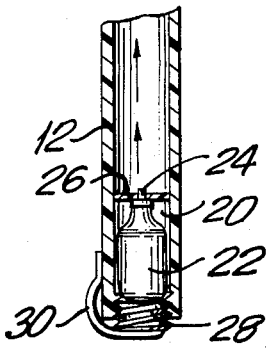

Other objects and advantages of the present invention will become apparent from a reading of the following specification and drawing wherein FIG. 1 is a perspective view of an embodiment of the umbrella of the present invention, FIG. 2 is a top view of the canopy of of the umbrella of FIG. 1 with arrows indicating the direction of the air flow, and FIG. 3 is a sectional view taken on line 3—3 of FIG. 1 in the direction of the arrows.

An embodiment of the present invention is shown fully inflated in the drawing consisting of canopy 10 and handle 12. It will be realized that for the sake of illustration the canopy is shown as a transparency. This has been done to best illustrate passages 14. In actual practice both the canopy and handle will more than likely be opaque. The actual material utilized will be of a readily inflatable plastic of which there is a wide variety available.

It may be seen that the canopy is provided with a variety of gas passages 14, some extending radially and others extending circularly, intersecting at numerous locations.

A relief valve 18 is provided at the apex of the canopy for releasing gas from the system. This valve may be of the screw variety and in FIG. 1 the screw is shown partially released. This screw and its threaded receptacle (not shown) have been designed so the screw cannot be completely detached from its receptacle and thereby lost.

Gas is introduced into the system from the base of handle 14 where compartment 20 is provided to house a cartridge 22 which will emit pressurized gas when punctured by needle 24. Such cartridges are known. Carbon dioxide is the gas generally employed.

In this instance the needle is supported by member 26 which bridges the passage within handle 12. The cartridge 22 is forced against needle 24 by the action of screw type closure 28. When the threaded closure is screwed into the end of the handle it will abut the base of cartridge 22 and force it against needle 24 to effect the rupture of the cartridge. The gas can escape from the cartridge through the needle and thus enter the system. Closure 28 can be tethered to the handle by member 30 so as not tobe readily lost. The gas will rush upwardly toward the apex of the canopy from where it will be evenly distributed to the gas passages to effect the rapid inflation of the umbrella.

It will be seen that by this invention an inflatable umbrella has been provided having a unique and efficient means of inflation, gas distribution and deflation.

Although only a single embodiment of the invention has been shown and described herein it will be realized that variations and modifications may be made which will fall within the spirit and letter of the following claims.

I claim:

1. An inflatable umbrella comprising, when inflated, a substantially circular canopy with a handle depending downwardly from its apex, said canopy and handle being constructed of readily inflatable material, said material being deflatable and when deflated being completely non-selfsupporting, the handle being tubular when inflated and having at its lower end a compartment for a cartridge which emits pressurized gas when punctured, a needle associated with said compartment for puncturing the cartridge to release gas therefrom to inflate the umbrella, a removable closure member for the compartment, the closure member having means for forcing the cartridge against the needle as well as closing off the handle at its lower end, the tubular handle being in communication with a plurality of air passages formed in the canopy, some of said passages extending radially from the apex of the canopy to its circumferential edge, others extending circularly around the canopy, at its apex, at its circumferential edge and in between, and intersecting the radially directed air passages, and valve means at the apex of the canopy for releasing gas from the umbrella to deflate the same.

* * * * *